US007527219B2

(12) United States Patent
Klick

(10) Patent No.: US 7,527,219 B2
(45) Date of Patent: May 5, 2009

(54) DEVICE FOR STORING GIFT WRAPPING ARTICLES

(76) Inventor: Valerie Klick, 425 10th Ave. E., Apt. 15, Seattle, WA (US) 98102

( * ) Notice: Subject to any disclaimer, the term of this patent is extended or adjusted under 35 U.S.C. 154(b) by 159 days.

(21) Appl. No.: 11/753,079

(22) Filed: May 24, 2007

(65) Prior Publication Data

US 2008/0290201 A1 Nov. 27, 2008

(51) Int. Cl.
*B65H 75/08* (2006.01)

(52) U.S. Cl. ..... 242/613; 242/608; 242/609

(58) Field of Classification Search ..... 242/608, 242/608.6–608.8, 609, 613, 613.2, 580, 118.4
See application file for complete search history.

(56) References Cited

U.S. PATENT DOCUMENTS 1,377,154 A * 5/1921 Flynn ..... 242/160.3
1,973,771 A * 9/1934 Mills ..... 242/608
3,763,619 A * 10/1973 Stone ..... 53/410
4,516,892 A * 5/1985 Curro, Jr. ..... 410/155
4,995,512 A * 2/1991 Liebel ..... 206/396
6,234,421 B1 * 5/2001 Cox et al. ..... 242/608.8

* cited by examiner

*Primary Examiner*—Sang Kim
(74) *Attorney, Agent, or Firm*—Jay M. Schloff; Intellipex PLLC

(57) ABSTRACT

Disclosed is a device for storing gift wrapping articles comprising: a hollow cylindrical body having open end portions and defining an inner surface and an outer surface between the open end portions; a pair of annular flanges extending radially outward from the outer surface at the open end portions; and a centerpiece disposed circumferentially along the inner surface of the hollow cylindrical body. The centerpiece comprises a central recess, and a plurality of cut out channels extending radially from the central recess to the inner surface of the hollow cylindrical body to form a plurality of truncated pie-shaped sections. The hollow cylindrical body is capable of holding multiple layers of a first gift wrapping article (multiple layers of ribbon) on the outer surface between the annular flanges. The truncated pie-shaped sections are flexible enough for removably receiving a second gift wrapping article (a wrapping paper roll) through the central recess.

4 Claims, 3 Drawing Sheets

DEVICE FOR STORING GIFT WRAPPING ARTICLES

FIELD OF THE INVENTION

The present invention generally relates to a device for storing gift wrapping articles, and, more particularly to a device for storing ribbon and wrapping paper roll.

BACKGROUND OF THE INVENTION

Ribbons have been commonly used to adorn gifts for various occasions. The ribbons may be used for wrapping, binding or tying gifts for various occasions, while also enhancing the aesthetic appeal of the gifts. Spools or reels have long been used to store the ribbons. Ribbons may be wound on the spools so that the ribbon may be unwound easily and in an orderly and controlled manner for use.

Usually the spools on which the ribbons are wound are flanged or un-flanged cylindrical hubs of any material. Such conventional spools serve the limited purpose of only storing the ribbons.

Also, ribbons have been commonly used in combination with other gift wrapping articles, such as, wrapping paper for wrapping, binding and tying gifts. The wrapping paper and the ribbons are stored usually in a generic bag or box or a closet. The end of the ribbon and the wrapping paper may be tacked down with piece of scotch tape in order to keep them from unraveling. Over the years, it is noticed that at various occasions, the wrapping paper(s) and the ribbon(s) get accumulated. All this leads to an unorganized and messy combination of wrapping paper and ribbon, particularly, when some of the wrapping paper and/or ribbon become lose or unraveled.

Accordingly, what is needed is a device that can be used for storing ribbon and wrapping paper together in a neat, convenient, and organized manner, while at the same time the device being manufactured in a cost-effective manner.

SUMMARY OF THE INVENTION

In view of the foregoing disadvantages inherent in the prior arts, the general purpose of the present invention is to provide a device for storing gift wrapping articles. The device is configured to include all the advantages of the prior art, and to overcome the drawbacks of the prior art.

In one aspect, the present invention provides a device for storing gift wrapping articles. The device comprises: a hollow cylindrical body having open end portions and defining an inner surface and an outer surface between the open end portions; a pair of annular flanges extending radially outward from the outer surface at the open end portions; and a centerpiece disposed circumferentially along the inner surface of the hollow cylindrical body. The centerpiece comprises a central recess, and a plurality of cut out channels extending radially from the central recess to the inner surface of the hollow cylindrical body to form a plurality of truncated pie-shaped sections. The hollow cylindrical body is capable of holding multiple layers of a first gift wrapping article (for example, multiple layers of ribbon) on the outer surface between the annular flanges. The truncated pie-shaped sections are flexible enough for removably receiving a second gift wrapping article (for example, a wrapping paper roll) through the central recess.

In another embodiment, the present invention may be used to store and transport sheets of other printed material such as blueprints, architectural drawings, maps, and the like.

These together with other aspects of the present invention, along with the various features of novelty that characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, wherein, like elements are identified with like symbols, and in which:

Like reference numerals refer to like parts throughout the description of several views of the drawings.

DETAILED DESCRIPTION OF THE INVENTION

The exemplary embodiments described herein detail for illustrative purposes are subject to many variations in structure and design. It should be emphasized, however, that the present invention is not limited to a particular a device for storing gift wrapping articles, as shown and described. It is understood that various omissions, substitutions of equivalents are contemplated as circumstances may suggest or render expedient, but is intended to cover the application or implementation without departing from the spirit or scope of the claims of the present invention. As used herein, the terms "a" and "an" do not denote a limitation of quantity, but rather, denote the presence of at least one of the referenced item.

The present invention provides a device for storing gift wrapping articles in a neat, convenient, and organized manner. Also the device may be manufactured in a cost-effective manner. The device is in the form of a spool having a centerpiece disposed inside the spool. The spool is designed to hold gift wrapping articles, such as, multiple layers of wrapping paper ribbon. The wrapping paper ribbon may be any standard ribbon that may be used for tying wrapping paper for aesthetic purposes. Additionally, the centerpiece is designed for securely grabbing onto rolled gift wrapping articles, such as, wrapping paper roll.

In another embodiment, the present invention may be used to store and transport sheets of other printed material such as blueprints, architectural drawings, maps, and the like.

Figure 1:
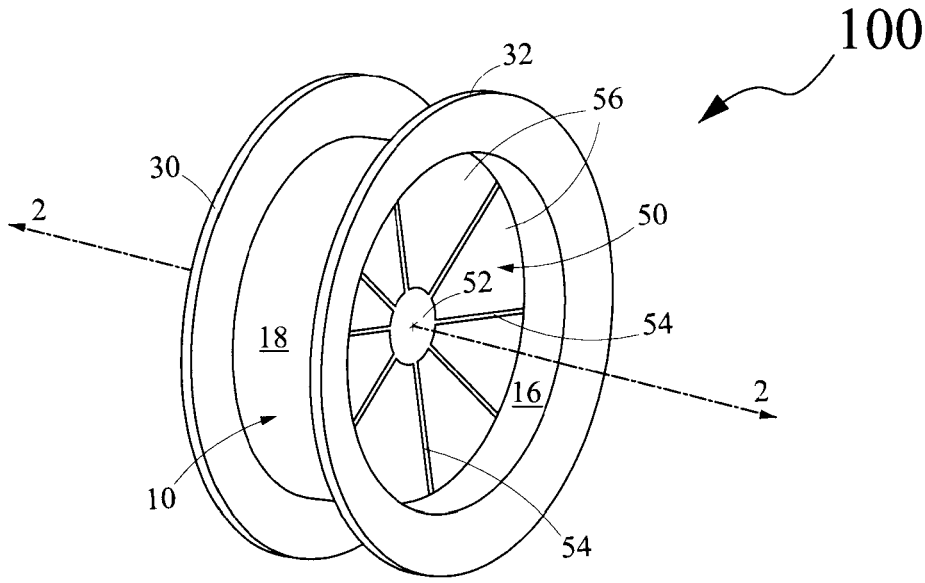
FIG. 1 is a perspective view of a device 100 for storing gift wrapping articles, according to an exemplary embodiment of the present invention.
Figure 2:
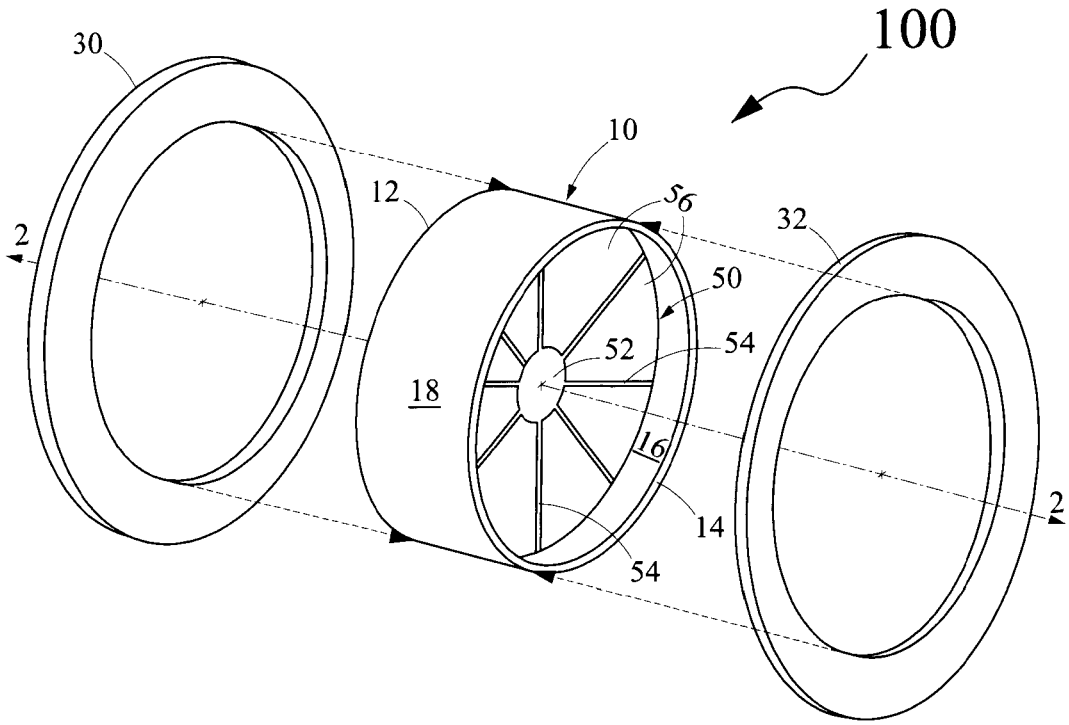
FIG. 2 is a partially exploded view of the device 100, according to an exemplary embodiment of the present invention.
Figure 3:
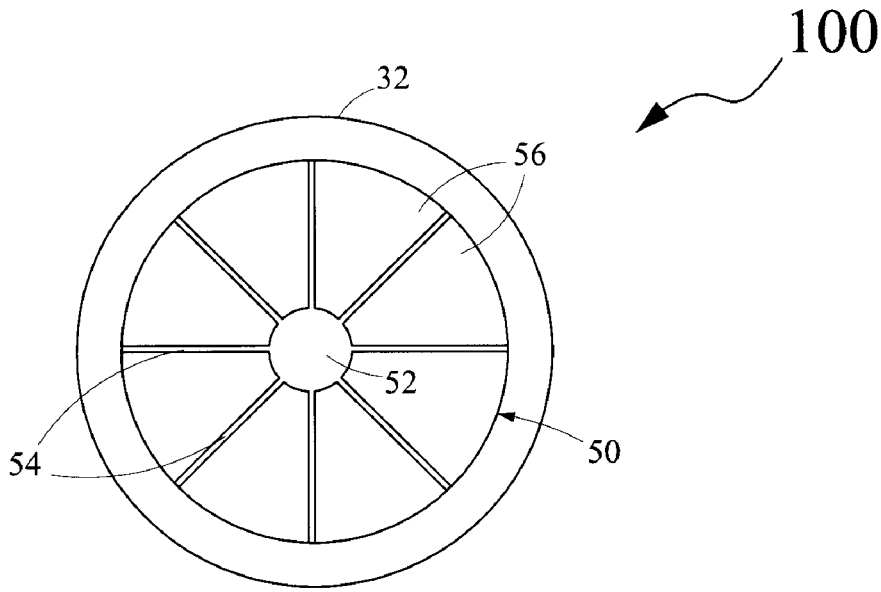
FIG. 3 is a side view of the device 100, according to an exemplary embodiment of the present invention.

Referring to FIGS. 1-3, a device 100 for storing gift wrapping articles is shown. The device 100 is in the form of a spool having a hollow cylindrical body 10 extending along a longitudinal axis 2-2, a pair of annular flanges 30, 32 and a centerpiece 50. The hollow cylindrical body 10 has open end portions 12, 14 and defines an inner surface 16 and an outer surface 18 between the open end portions 12, 14. The annular flanges 30, 32 extend radially outward from the outer surface 18 at the open end portions 12, 14. The centerpiece 50 is disposed circumferentially along the inner surface 16 of the hollow cylindrical body 10. The centerpiece 50 is disposed substantially centrally between the open end portions 12, 14, inside the hollow cylindrical body 10. As shown in FIGS. 1 and 2, the centerpiece 50 is disposed perpendicular to the longitudinal axis 2-2. The centerpiece 50 has: a central recess 52; and a plurality of cut out channels 54 extending radially from the central recess 52 to the inner surface 16 of the hollow cylindrical body 10 to form a plurality of truncated pie-shaped sections 56. The truncated pie-shaped sections 56 extend radially from the central recess 52 to the inner surface 16 of the hollow cylindrical body 10. In one embodiment, the centerpiece 50 has eight cut out channels 54, forming eight truncated pie-shaped sections 56 extending along a complete circumference of the inner surface 16 of the hollow cylindrical body 10.

Figure 4:
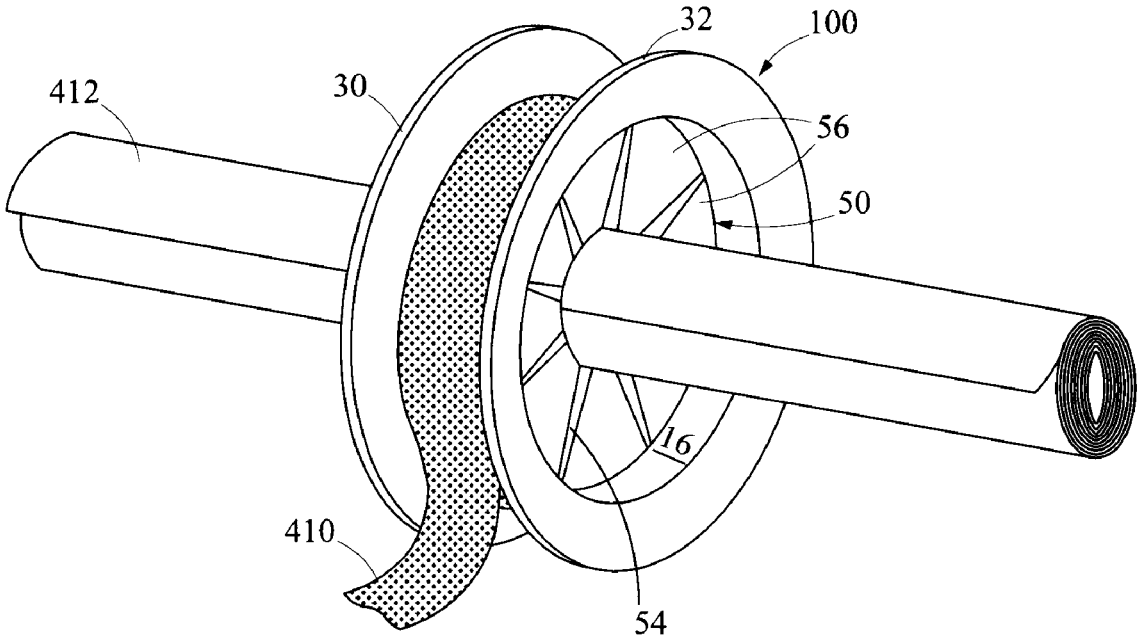
FIG. 4 is a perspective view of the device 100 storing a ribbon 410 and a wrapping paper roll 412, according to an exemplary embodiment of the present invention.
Figure 5:
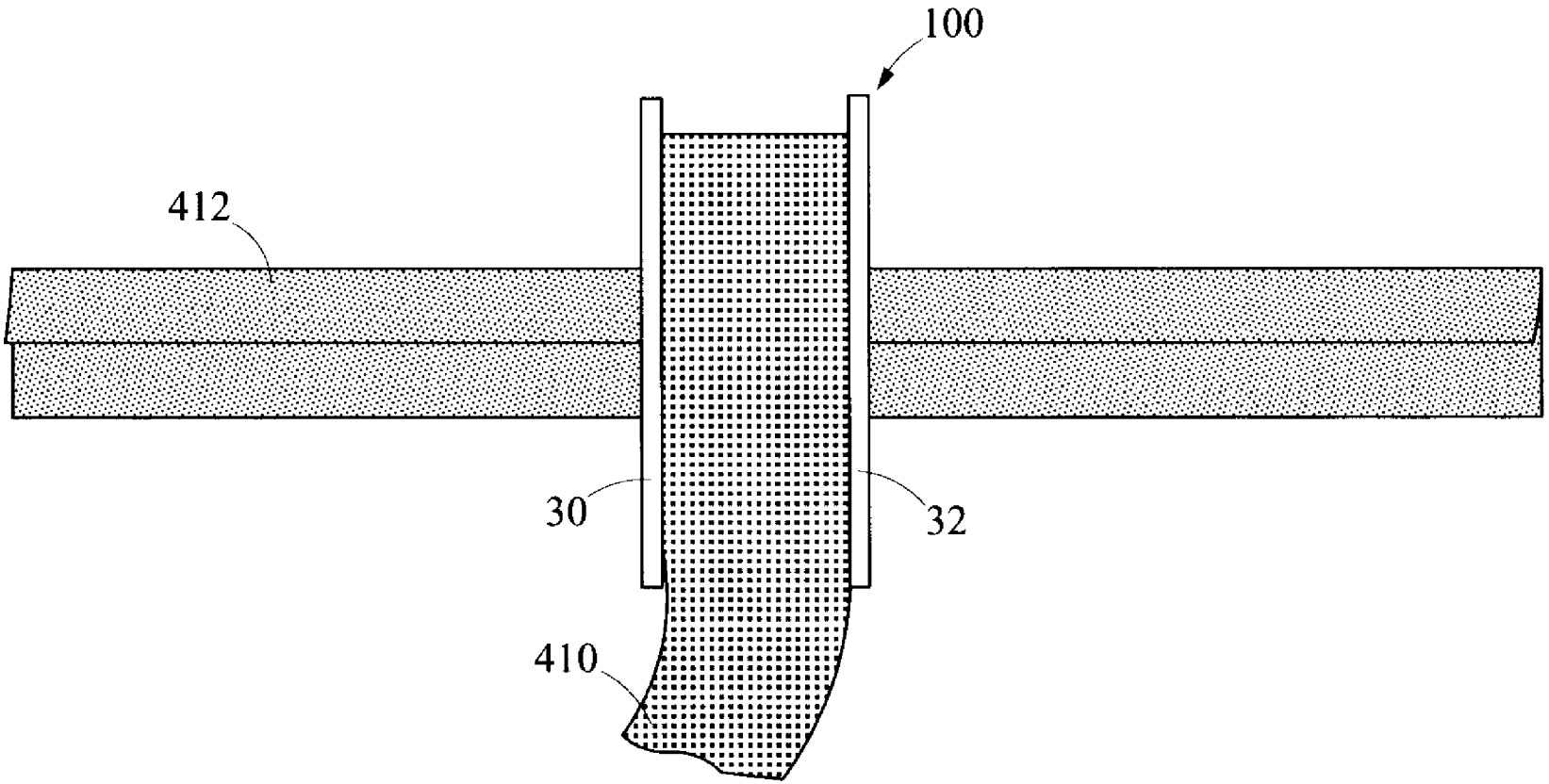
FIG. 5 is a front view of the device 100 storing the ribbon 410 and the wrapping paper roll 412, according to an exemplary embodiment of the present invention.

Referring to FIGS. 4 and 5, in one embodiment, the device 100 is capable of storing a ribbon 410 and a wrapping paper roll 412. In this embodiment, the ribbon 410 and the wrapping paper roll 412 are conveniently interlocked by the device 100 for ease of storage. More specifically, the hollow cylindrical body 10 is capable of holding multiple layers of the ribbon 410 on the outer surface 18 between the annular flanges 30, 32. The annular flanges 30, 32 act as retainers for keeping the multiple layers of the ribbon 410 from slipping off the hollow cylindrical body 10, and further preventing the ribbon 410 from getting twisted or damaged.

The centerpiece 50 is configured in a manner, such that, the device 100 may be easily slid onto the wrapping paper roll 412, through the central recess 52, for securely grabbing onto the wrapping paper roll 412. In this position, the wrapping paper roll 412 is prevented from unraveling. More specifically, the truncated pie-shaped sections 56 are flexible enough for removably receiving the wrapping paper roll 412 through the central recess 52. Due to this flexibility, the truncated pie-shaped sections 56 may adjustably deflect out of the plane of the centerpiece 50 for securely accommodating the wrapping paper roll 412 through the central recess 52. The truncated pie-shaped sections retain their original position, once the wrapping paper roll 412 is taken out of the centerpiece 50 i.e. removed completely from the central recess 52. Although, the device 100 may be capable of receiving wrapping paper roll 412 of various diameters depending upon the flexibility of the truncated pie-shaped sections 56; the overall size of the device 100 (i.e., the size of the hollow cylindrical body 10, the central recess 52 and the truncated pie-shaped sections 56) and the flexibility of the centerpiece 50 (i.e., the flexibility of the truncated pie-shaped sections 56) may be varied based on the size of the wrapping paper roll.

Also, the outer surface 18 of the hollow cylindrical body 10 may be loaded with the ribbon 410 by rotating the device 100 along the longitudinal axis 2-2.

The device 100 may be made of any material providing sufficient structural integrity for storing the gift wrapping articles, and at the same time providing sufficient flexibility to the truncated pie shaped sections 56 for removably receiving the wrapping paper roll 412. The device 100 may be a one-piece casting made of a single material. Alternatively, the hollow cylindrical body 10, the annular flanges 30, 32, and the centerpiece 50 may be independently made from different materials. In one embodiment, the device 100 may be injection molded from a thermoplastic material. Suitable thermoplastic materials include, but are not limited to, polyolefines, polyesters, polyamides, polyvinyl chloride, polybutylene terephthalate, and acrylonitrile butadiene styrene.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is understood that various omissions, substitutions of equivalents are contemplated as circumstance may suggest or render expedient, but is intended to cover the application or implementation without departing from the spirit or scope of the claims of the present invention.

What is claimed is:

1. A device for storing gift wrapping articles, comprising:

a hollow cylindrical body having open end portions and defining an inner surface and an outer surface between the open end portions;

a pair of annular flanges extending radially outward from the outer surface at the open end portions; and a centerpiece disposed circumferentially along the inner surface of the hollow cylindrical body, the centerpiece comprising a central recess, and a plurality of cut out channels extending radially from the central recess to the inner surface of the hollow cylindrical body to form a plurality of truncated pie-shaped sections;

wherein the hollow cylindrical body is capable of holding multiple layers of a first gift wrapping article on the outer surface between the annular flanges; and wherein the truncated pie-shaped sections are flexible enough for removably receiving a second gift wrapping article through the central recess.

2. The storage device of claim 1, wherein the storage device is injection molded from a thermoplastic material.

3. The storage device of claim 1, wherein the first gift wrapping article is a ribbon.

4. The storage device of claim 1, wherein the second gift wrapping article is wrapping paper roll.

* * * * *